US005328434A

United States Patent [19]

Carroll

[11] Patent Number: 5,328,434

[45] Date of Patent: Jul. 12, 1994

[54] APPARATUS TO AID IN PERFORMING SIT-UPS

[76] Inventor: Kevin Carroll, P.O. Box 531390, Birmingham, Ala. 35253-1390

[21] Appl. No.: 137,407

[22] Filed: Oct. 18, 1993

[51] Int. Cl.[5] ..... A63B 26/00

[52] U.S. Cl. ..... 482/140; 482/145; 482/148

[58] Field of Search ..... 482/145, 140, 148; 242/124, 107; 248/205.5, 363, 206.3, 206.4; 362/397

[56] References Cited

U.S. PATENT DOCUMENTS

| | | | |
|---|---|---|---|
| 533,276 | 1/1895 | Crong | 242/107 |
| 637,795 | 11/1899 | Jacobs | 242/107 |
| 752,558 | 2/1904 | Hynson | 242/107 |
| 893,981 | 7/1908 | Cammann | 242/107 |
| 1,530,784 | 3/1925 | Midgley | 248/206.3 |
| 2,046,653 | 7/1936 | Petcoff | 482/145 |
| 2,502,714 | 4/1950 | Garnett | 248/206.3 |
| 4,121,825 | 10/1978 | Hult | 482/140 |
| 4,147,387 | 4/1979 | Coenan | 242/107 |
| 4,489,936 | 12/1984 | Dal Monte | 482/145 |
| 4,593,902 | 6/1986 | Michaelsen | 482/140 |
| 4,602,782 | 7/1986 | Carlson | 482/140 |
| 5,160,306 | 11/1992 | Lui | 482/140 |

*Primary Examiner*—Richard J. Apley
*Assistant Examiner*—Jerome Donnelly
*Attorney, Agent, or Firm*—Hugh E. Smith

[57] ABSTRACT

Apparatus as an aid while performing bent knee sit-ups, comprising, in combination a strap of material adapted to extend and be positioned over the ankles of a person doing bent knee sit-ups, when in a deployed orientation, but adapted to be rolled up when in a storage orientation; a pair of assemblies, each assembly having a hollow base in a rectangular configuration with a slot within the upper surface for the passage of one end of the strap, each base having a circular hole for the passage of a fixed plug, each base having a cylindrical tube rotatively secured around the plug with a spring secured at one end of the plug and secured at the other end to the interior of the tube, and with one end of the strap secured to the exterior surface of the tube wherein the ends of the strap may be coiled about the tube when the spring is released and the assemblies in close proximity to each other when in a storage orientation, but wherein the assemblies may be spread apart to extend the strap to the deployed orientation with the springs in a tension state; and securement means adapted to secure the assemblies to a surface.

5 Claims, 4 Drawing Sheets

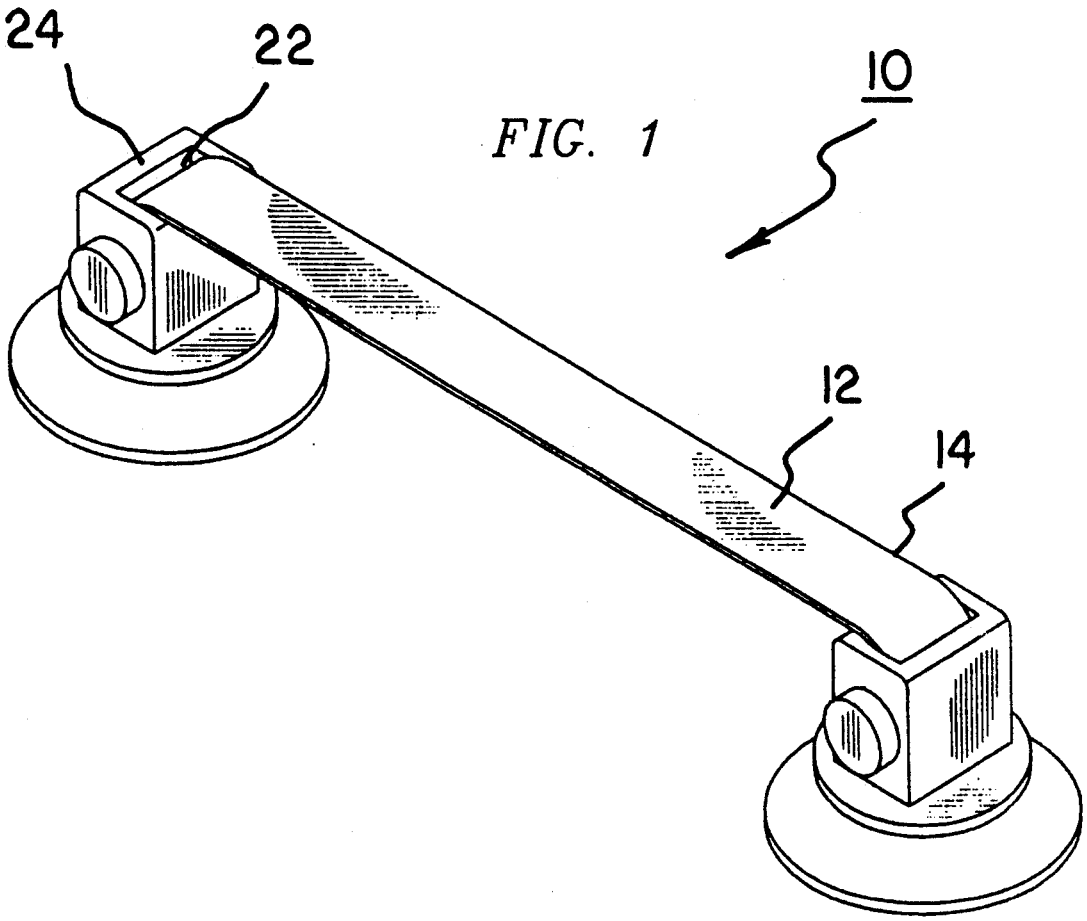
FIG. 1
FIG. 2
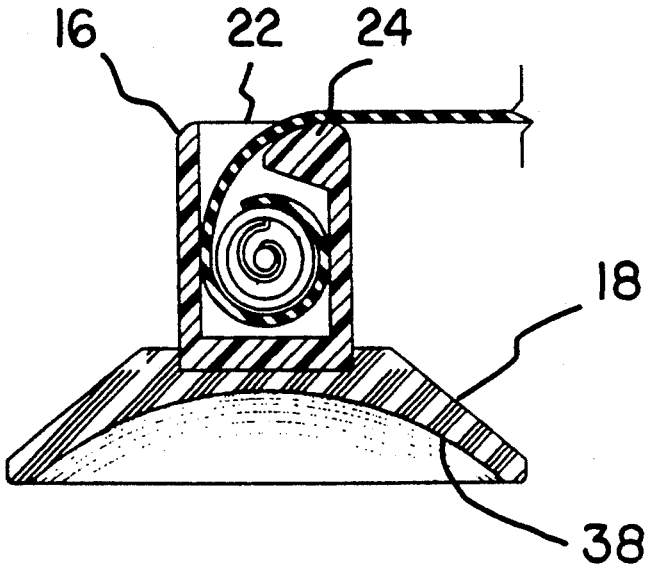

APPARATUS TO AID IN PERFORMING SIT-UPS

BACKGROUND OF THE INVENTION

1. Field of the Invention

The present invention relates to an aid for performing sit-ups and more particularly pertains to an aid that includes a strap of material which can be extended across the ankles of a user and includes two assemblies for receiving the strap of material in a rolled up orientation.

2. Description of the Prior Art

The use of exercising devices is known in the prior art. More specifically, foot holding devices for use in conjunction with performing exercises are known to consist basically of familiar, expected and obvious structural configurations, notwithstanding the myriad of designs encompassed by the crowded art which have been developed for the fulfillment of countless objectives and requirements.

For example, U.S. Pat. No. 5,163,889 discloses a portable foot/hand holding device used in performing sit-ups. The device is constructed of three parts; an anchor, a connecting line and a foot/hand bar. The device is used in conjunction with a walk-through door.

U.S. Pat. No. 3,682,475 discloses an exercising device which includes a foot restraining means. The foot holding bar can be positioned at a number of locations.

U.S. Pat. No. 4,705,270 discloses a portable exercise device. The device is adapted to extend beneath a door and provide an anchor for one or more body parts of an individual performing exercises.

U.S. Pat. No. 4,629,179 discloses a foot holding apparatus for use in performing sit-up exercises the apparatus has a pair of foot holding devices each of which are provided with a clamping device by which it can be secured to the bottom of a door.

Still yet another example is U.S. Pat. No. 4,121,825 which discloses a portable foot anchor for exercising. The anchor is adapted to engage the lower portion of a door when the latter is in a closed position.

While these exercising devices fulfill their respective, particular objectives and requirements, the aforementioned patents do not describe an apparatus which includes a retractable strap which is adapted to be secured over the ankles of a user. Furthermore, the prior art devices do not illustrate an apparatus for performing sit-ups which can be secured to the floor or ground.

In this respect, the apparatus according to the present invention substantially departs from the conventional concepts and designs of the prior art, and in so doing provides an apparatus that is useful in aiding a person performing bent knee or straight leg sit-ups.

Therefore, it can be appreciated that there exists a continuing need for new and improved apparatus to aid in performing sit-ups. In this regard, the present invention substantially fulfills this need.

SUMMARY OF THE INVENTION

In view of the foregoing disadvantages inherent in the known types of exercise devices now present in the prior art, the present invention provides an improved apparatus to aid in performing sit-ups. As such, the general purpose of the present invention, which will be described subsequently in greater detail, is to provide a new and improved apparatus to aid in performing sit-ups apparatus and method which has all the advantages of the prior art exercise devices and none of the disadvantages.

To attain this, the present invention essentially comprises a new and improved apparatus as an aid while performing bent knee sit-ups, comprising, in combination a strap of flexible material adapted to extend and be positioned over the ankles of a person doing bent knee sit-ups, when in a deployed orientation, but adapted to be rolled up when in a storage orientation; a pair of assemblies, each assembly having a hollow base in a rectangular configuration with a slot within the upper surface for the passage of one end of the strap, each base having a circular hole for the passage of a fixed plug, each base having a cylindrical tube rotatively secured around the plug with a coil spring secured at one end of the plug and secured at the other end to the interior of the tube, and with one end of the strap secured to the exterior surface of the tube wherein the ends of the strap may be coiled about the tube when the coil spring is released and the assemblies are in close proximity to each other when in a storage orientation, but wherein the assemblies may be spread apart to extend the strap to the deployed orientation with the springs coiled in a tension state; and suction cups secured to the faces of the bases opposite from the slots to secure the bases in a fixed position and the coil springs in tension with the strap extended for operation and use.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved apparatus to aid in performing sit-ups which has all the advantages of the prior art exercise devices and none of the disadvantages.

It is another object of the present invention to provide a new and improved apparatus to aid in performing sit-ups which may be easily and efficiently manufactured and marketed.

It is a further object of the present invention to provide a new and improved apparatus to aid in performing sit-ups which is of a durable and reliable construction.

An even further object of the present invention is to provide a new and improved apparatus to aid in performing sit-ups which is susceptible of a low cost of manufacture with regard to both materials and labor, and which accordingly is then susceptible of low prices of sale to the consuming public, thereby making such apparatus to aid in performing sit-ups economically available to the buying public.

Still yet another object of the present invention is to provide a new and improved apparatus to aid in performing sit-ups which provides in the apparatuses and methods of the prior art some of the advantages thereof, while simultaneously overcoming some of the disadvantages normally associated therewith.

Still another object of the present invention is to make exercising more convenient, a one person activity.

Yet another object of the present invention is to allow an exerciser to do sit-ups, any time, any where.

Even still another object of the present invention is to provide a new and improved apparatus as an aid while performing bent knee sit-ups, comprising, in combination a strap of material adapted to extend and be positioned over the ankles of a person doing bent knee sit-ups, when in a deployed orientation, but adapted to be rolled up when in a storage orientation; a pair of assemblies, each assembly having a hollow base in a rectangular configuration with a slot within the upper surface for the passage of one end of the strap, each base having a circular hole for the passage of a fixed plug, each base having a cylindrical tube rotatively secured around the plug with a spring secured at one end of the plug and secured at the other end to the interior of the tube, and with one end of the strap secured to the exterior surface of the tube wherein the ends of the strap may be coiled about the tube when the spring is released and the assemblies in close proximity to each other when in a storage orientation, but wherein the assemblies may be spread apart to extend the strap to the deployed orientation with the springs in a tension state; securement means adapted to secure the assemblies to a surface;

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a perspective view of the first embodiment of the invention employing the principles of the present invention.

FIG. 2 is a cross sectional view taken through one of the bases of FIG. 1.

DESCRIPTION OF THE PREFERRED EMBODIMENT

Figure 3:
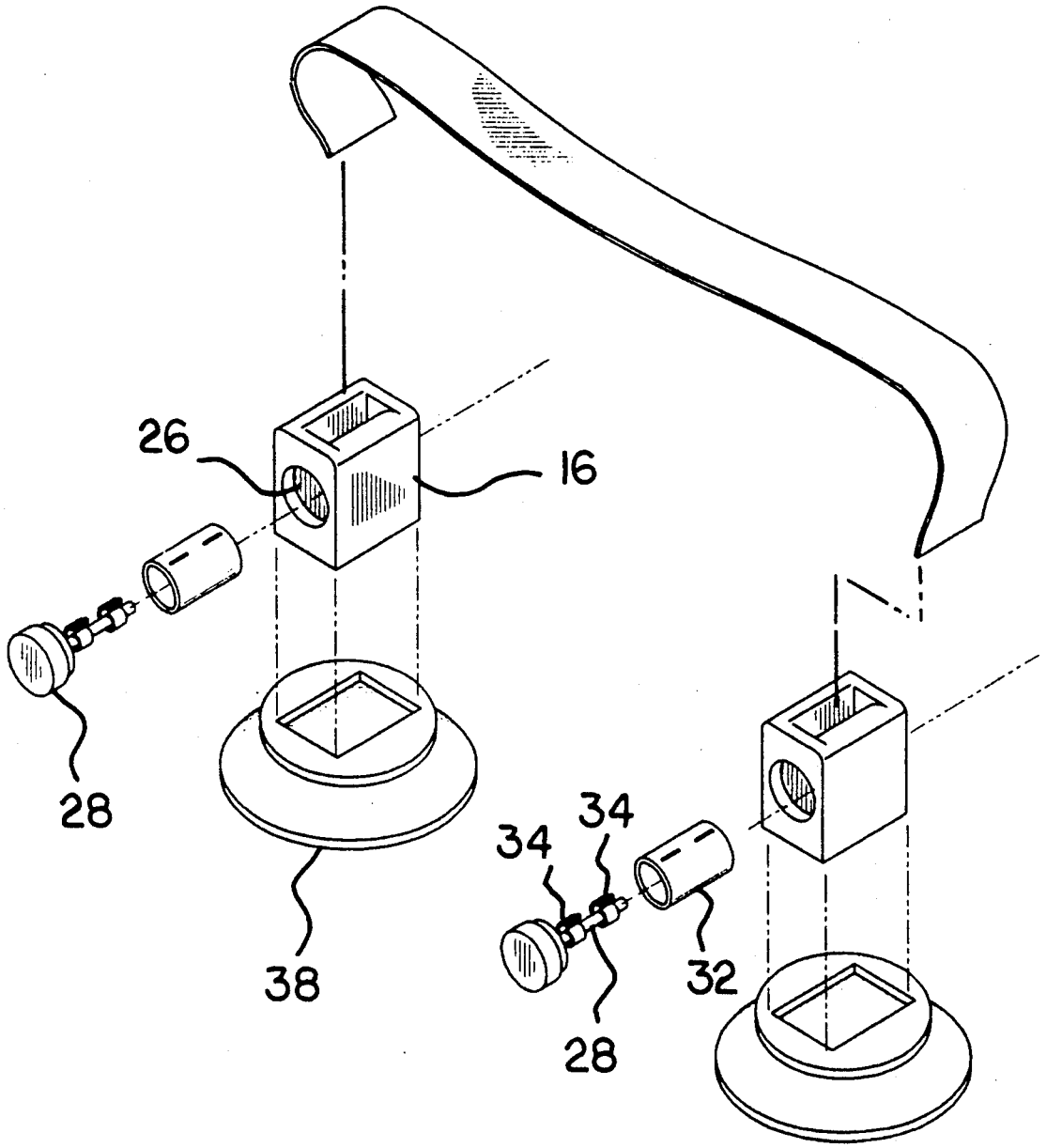
FIG. 3 is an exploded perspective view of the apparatus of FIG. 1.

With reference now to the drawings, and in particular to FIG. 1 thereof, a new and improved apparatus to aid in performing sit-ups embodying the principles and concepts of the present invention and generally designated by the reference numeral 10 will be described.

The present invention relates to an exercising aid 10. The aid enables the user to perform bent knee or straight leg sit-ups. The aid 10 includes the following elements, a strap 12 of flexible material 14 which is adapted to be extended and positioned over the ankles of a person doing sit-ups, a pair of hollow bases 16 each of which is adapted to receive the flexible material 14 in a rolled up orientation, and securement devices 18 or securing the bases to the floor or ground.

The strap of material 14 is of a length that it can be positioned over the ankles of any person performing bent knee sit-ups. The material from which the strap is formed is strong yet flexible. A rubber or plastic material meets the necessary requirements. When the strap is extended in the deployed orientation it is extended and positioned over the ankles of the user. However, when the strap is in the storage orientation, it is rolled up within the bases 16.

Each base assembly 16 includes a hollow base formed of a rigid material, as of polyvinyl chloride (PVC) or the like, in a rectangular configuration. Each of the bases has a slot 22 formed within it upper surface 24 for the passage of one end of the strap. Furthermore, each of the bases incorporates a circular hole 26 for the passage of a fixed plug 28.

Rotatively secured around each plug 28 is a cylindrical tube 32. A coil spring or springs 34 are fixed within each of the bases. Each coil spring 32 has one end secured to the plug and another end secured to the interior of the cylindrical tube 32. Additionally, one end of each strap 12 is secured to the exterior surface of the tube 32. Thus, the ends of the strap are coiled about the tube when the coil spring is in a relieved orientation or released and the assemblies are in close proximity to one another. When the strap 12 and the assemblies are in the orientation as described the apparatus is in its storage orientation. However, the assemblies may be spread apart with the springs 34 coiled in a tension state, and with the strap 14 extended in the deployed orientation for operation and use.

In the first embodiment of FIGS. 1 through 3, the securement devices 18 employed are suction cups 38. Each suction cup 38 is secured to the face of each base 16 to a surface 40 opposite from the slot 22. The suction cups are used to secure the bases to a floor or other planar surface. The suction cups 38 secure the bases 16 in a fixed position, as by frictional contact keeping the coil springs 32 in tension positioning the strap 12 in its extended orientation for operation and use.

The apparatus 10 as described above is used as follows. The device 10 is originally in the stored orientation. In this orientation the assemblies 16 are in close proximity to one another and the coil springs 32 are not in a tensioned state. Furthermore, in the stored orientation one half the strap 12 is rolled up into one base 16, and one half the strap 12 is rolled up into the other base 16. When in the stored orientation the device can be easily transported or stored in a location with little space.

To bring the apparatus 10 to its deployed orientation, the assemblies 16 are separated from one another and secured to the floor by way of the suction cups. The user may stretch out the bases to extend the strap 12 and then engage both suction cups 38, or in the alternative, engage one suction cup 38, extend the strap by moving the other base and then engaging the section suction cup.

Figure 4:
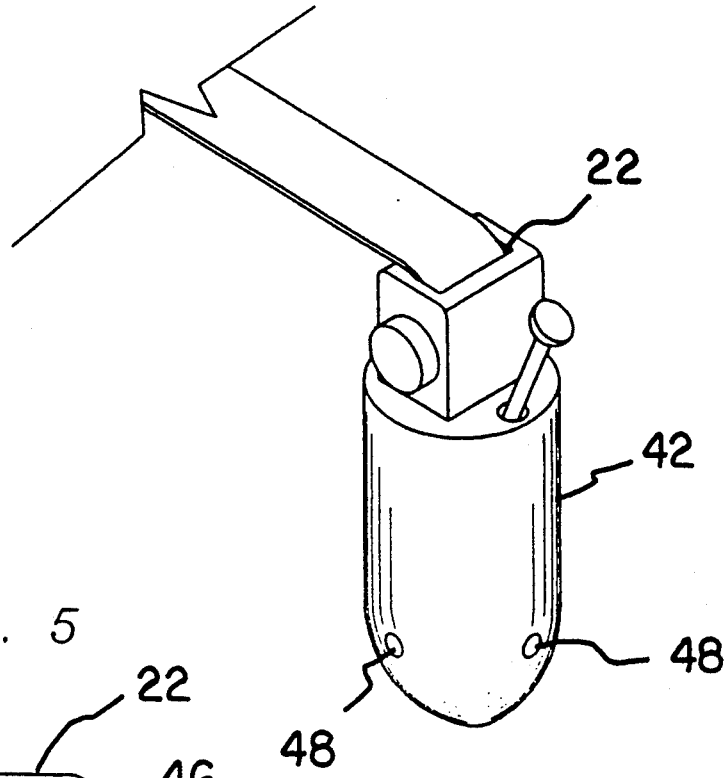
FIG. 4 is a view of the bullet shaped housing in accordance with the second embodiment of the invention.
Figure 5:
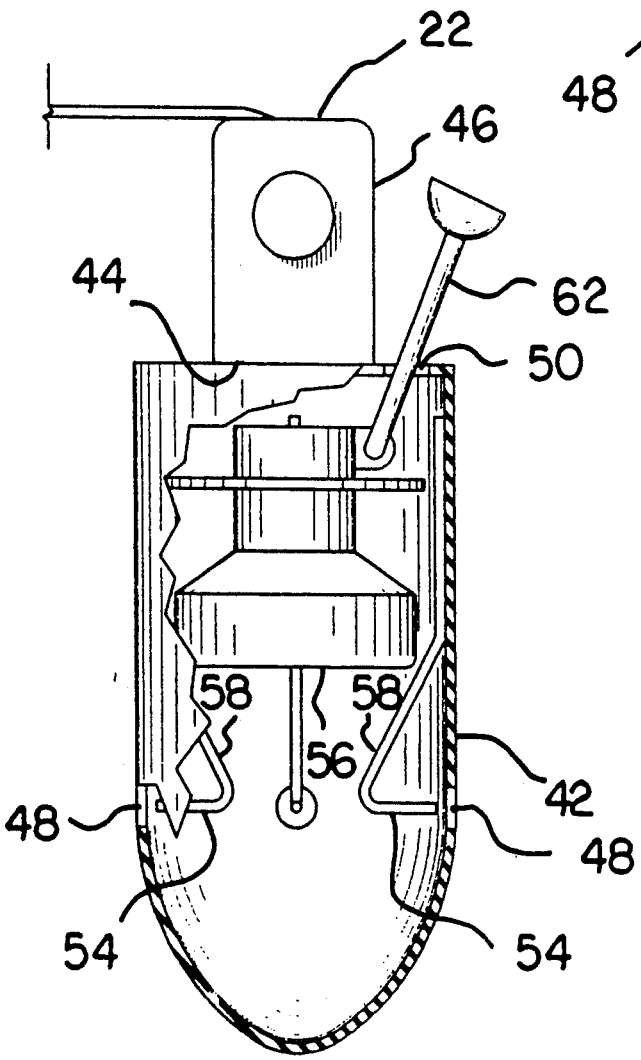
FIG. 5 is a cross sectional view of the bullet shaped housing of FIG. 4.
Figure 6:
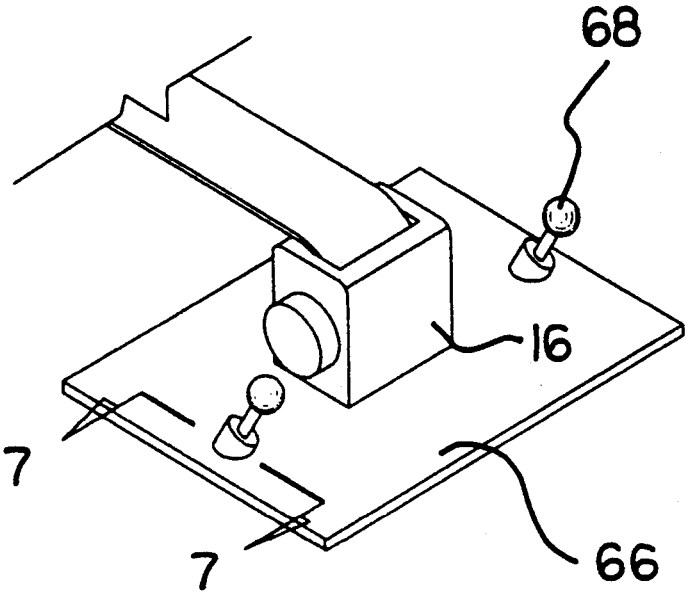
FIG. 6 is a perspective view of the planar base in accordance with the third embodiment of the invention.
Figure 7:
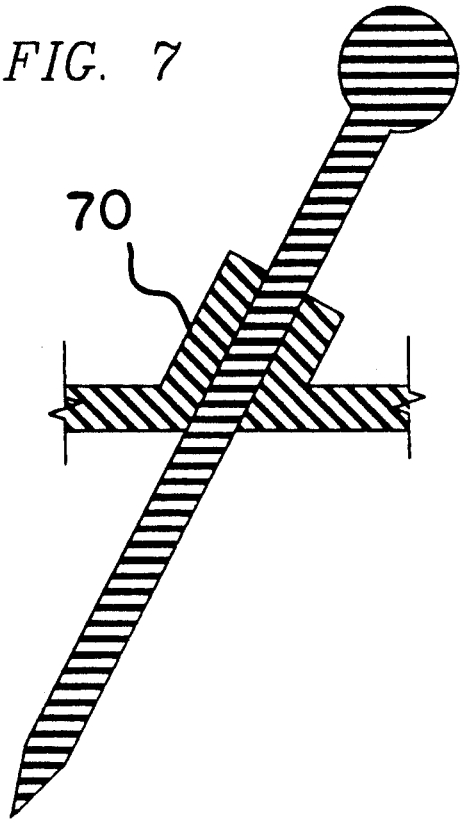
FIG. 7 is a cross sectional view of the pin and planar base taken along line of FIG. 6.

In the second embodiment, that shown in FIGS. 4 and 5, the suction cups are replaced by two hollow bullet shaped housings 42. The housings 42 are secured to the faces of 44 the bases 46 opposite from the slots 22 as by an adhesive. Such housings 42 are used for securing the bases into the earth. Each of the housings 42 includes four spaced apertures 48 intermediate the length of the housing, and one aperture 50 adjacent the base 46.

Within each of the housings 42 are four interior moving resilient spikes 54. The spikes 54 are adapted to be forced out through the intermediate apertures 48 for deployment and use. A plunger element 56 is slidable received within each housing 42. It is adapted to engage the four moving spikes 54 and force them through the apertures 48. The plunger element 56 preferably employ surfaces to engage sloped sidewalls 58 of the spikes 54. A plastic punch 62 extends through the aperture 50 adjacent the base and is adapted to push the plunger element 56 through the housing 42 for enjoyment of spikes 54 into a holding position for their withdrawal. The withdrawl of the plunger 56 allows the resilience of the spikes 54 to release their grip in the ground to return to the orientation of FIGS. 4 and 5.

The apparatus of the second embodiment is used as follows: The apparatus is taken to an out of doors location. Originally, as in the first embodiment, the apparatus is in its stored orientation with the two assemblies in close proximity to one another. After the apparatus is taken outside, the assemblies are separated from one another to extend the strap and place the apparatus in its deployed orientation. The two bullet shaped housing are then forced into the ground. By the application of force to the punch, the plunger is forced through the interior of the housing and the four spikes are extended through the apertures. The four spikes serve as anchors for the housings within the ground.

In the third embodiment, the bullet shaped housings are replaced by a planar planes 66 and spikes 68. In this embodiment, a plate 66 is secured to each base 16. Spikes 68 extend through the plate for being advanced for locking and for being withdrawn for releasing. An angled bearing surface 70 extends upwardly from the plate for guiding the pin at an angled orientation for maximum holding efficiency.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved apparatus as an aid while performing bent knee sit-ups, comprising, in combination:

a strap of flexible material adapted to extend and be positioned over the ankles of a person doing bent knee sit-ups, when in a deployed orientation, but adapted to be rolled up when in a storage orientation;

a pair of assemblies, each assembly having a hollow base in a rectangular configuration with a slot within the upper surface for the passage of one end of the strap, each base having a circular hole for the passage of a fixed plug, each base having a cylindrical tube rotatively secured around the plug with a coil spring secured at one end of the plug and secured at the other end to the interior of the tube, and with one end of the strap secured to the exterior surface of the tube wherein the ends of the strap may be coiled about the tube when the coil spring is released and the assemblies are in close proximity to each other when in a storage orientation, but wherein the assemblies may be spread apart to extend the strap to the deployed orientation with the springs coiled in a tension state; and suction cups secured to the faces of the bases opposite from the slots to secure the bases in a fixed position and the coil springs in tension with the strap extended for operation and use.

2. Apparatus as an aid while performing bent knee sit-ups, comprising, in combination:

a strap of material adapted to extend and be positioned over the ankles of a person doing bent knee sit-ups, when in a deployed orientation, but adapted to be rolled up when in a storage orientation;

a pair of assemblies, each assembly having a hollow base in a rectangular configuration with a slot within the upper surface for the passage of one end of the strap, each base having a circular hole for the passage of a fixed plug, each base having a cylindrical tube rotatively secured around the plug with a spring secured at one end of the plug and secured at the other end to the interior of the tube, and with one end of the strap secured to the exterior surface of the tube wherein the ends of the strap may be coiled about the tube when the spring is released and the assemblies in close proximity to each other when in a storage orientation, but wherein the assemblies may be spread apart to extend the strap to the deployed orientation with the springs in a tension state; and securement means adapted to secure the assemblies to a surface.

3. The apparatus as set forth in claim 2 wherein the securement means are suction cups.

4. The apparatus as set forth in claim 2 wherein the securement means comprises two hollow bullet shaped housings for securing the bases to the earth, the hollow bullet shaped housings secured to the faces of the bases opposite from the slots, each of the housings having spaced apertures intermediate its length, and one aperture adjacent the base, a plurality of interior moving spikes adapted to be forced out through the apertures, a plunger element slidable received within the housing and adapted to engage the moving spikes and force them through the apertures and a punch extending through the aperture adjacent the base and adapted to push the plunger element through the housing.

5. The apparatus as set forth in claim 2 wherein the securement means comprises a plate secured to each base, each plate having a plurality of angled bearing surfaces extending upwardly therefrom and a spike slidable received therethrough.

* * * * *